US005647536A

United States Patent [19]

Yen et al.

[11] Patent Number: 5,647,536

[45] Date of Patent: Jul. 15, 1997

[54] INJECTION RATE SHAPING NOZZLE ASSEMBLY FOR A FUEL INJECTOR

[75] Inventors: B. M. Yen; Lester L. Peters; J. P. Perr; A. S. Ghuman; Dennis Ashwill, all of Columbus, Ind.

[73] Assignee: Cummins Engine Company, Inc., Columbus, Ind.

[21] Appl. No.: 376,417

[22] Filed: Jan. 23, 1995

[51] Int. Cl.[6] ..... F02M 47/02

[52] U.S. Cl. ..... 239/90; 239/92; 239/124

[58] Field of Search ..... 239/88, 90–2, 239/96, 533.1–533.4, 533.9, 124, 125, 585.1

[56] References Cited

U.S. PATENT DOCUMENTS

| | | | |
|---|---|---|---|
| 2,439,257 | 3/1948 | Lum | 285/96.3 |
| 2,613,998 | 10/1952 | Noon et al. | 239/133 |
| 2,959,360 | 11/1960 | Nichols | 239/533 |
| 3,241,768 | 3/1966 | Croft | 239/124 |
| 3,379,374 | 4/1968 | Mekkes | 239/90 |
| 3,669,354 | 6/1972 | Helyer | 239/126 |
| 3,669,360 | 6/1972 | Knight | 239/533 |
| 3,718,283 | 2/1973 | Fenne | 239/533 |
| 3,747,857 | 7/1973 | Fenne | 239/90 |
| 3,817,456 | 6/1974 | Schlappkohl | 239/533 |
| 4,168,804 | 9/1979 | Hofmann | 239/533.11 |
| 4,179,069 | 12/1979 | Knapp et al. | 239/125 |
| 4,184,459 | 1/1980 | Ishii et al. | 123/32 |
| 4,258,883 | 3/1981 | Hofmann et al. | 239/124 |
| 4,292,947 | 10/1981 | Tanasawa et al. | 123/445 |
| 4,394,964 | 7/1983 | Ecomard et al. | 239/90 |
| 4,463,901 | 8/1984 | Perr et al. | 239/95 |
| 4,508,275 | 4/1985 | Hofmann et al. | 239/533.3 |
| 4,538,576 | 9/1985 | Schneider | 239/88 |
| 4,758,169 | 7/1988 | Steiger | 239/96 |
| 4,804,143 | 2/1989 | Thomas | 239/126 |
| 4,805,837 | 2/1989 | Brooks et al. | 239/125 |
| 4,811,715 | 3/1989 | Djordjevic et al. | 123/497 |
| 4,889,288 | 12/1989 | Gaskell | 239/533.5 |
| 4,892,065 | 1/1990 | List | 123/26 |
| 4,993,926 | 2/1991 | Cavanagh | 417/490 |
| 5,020,500 | 6/1991 | Kelly | 123/467 |
| 5,029,568 | 7/1991 | Perr | 123/447 |
| 5,042,718 | 8/1991 | Bergmann et al. | 239/585.1 |
| 5,133,645 | 7/1992 | Crowley et al. | 417/279 |
| 5,419,492 | 5/1995 | Gant et al. | 239/88 |
| 5,421,521 | 6/1995 | Gibson et al. | 239/585.4 |
| 5,487,508 | 1/1996 | Zuo | 239/533.5 |

FOREIGN PATENT DOCUMENTS

| | | | |
|---|---|---|---|
| 759420 | 5/1943 | Germany . | |
| 3205669 | 12/1982 | Germany | 239/124 |
| 3818862 | 12/1988 | Germany . | |
| 450866 | 2/1949 | Italy . | |
| 2079369 | 1/1982 | United Kingdom . | |
| 2129052 | 5/1984 | United Kingdom . | |

*Primary Examiner*—Andres Kashnikow
*Assistant Examiner*—Lisa Ann Douglas
*Attorney, Agent, or Firm*—Sixbey, Friedman, Leedom & Ferguson; Charles M. Leedom, Jr.; Tim L. Brackett, Jr.

[57] ABSTRACT

An injection rate shaping nozzle assembly for a fuel injector is provided which includes a closed nozzle valve element and a rate shaping control device including an injection spill circuit for spilling a portion of the fuel to be injected to produce a predetermined time varying change in the flow rate of fuel injected into a combustion chamber. The spill circuit includes a spill passage integrally formed in the nozzle valve element. The rate shaping control may include a spill valve for controlling the spill flow through the spill circuit to create a low injection flow rate followed by a high injection flow rate. The spill passage may communicate with the injector nozzle cavity between injection events or alternatively may be blocked to prevent spill flow between injection events. The rate shaping control device may include a spill accelerating device in the form of a spill chamber formed in the nozzle valve element for creating a rapid increase in the spill flow rate. In another embodiment, the rate shaping device may include a throttling passage integrally formed in the nozzle valve element to vary the rate at which fuel pressure in the nozzle cavity increases so as to vary the flow rate through the injector orifices.

28 Claims, 5 Drawing Sheets

INJECTION RATE SHAPING NOZZLE ASSEMBLY FOR A FUEL INJECTOR

TECHNICAL FIELD

This invention relates to an improved nozzle assembly for fuel injectors which effectively controls the flow rate of fuel injected into the combustion chamber of an engine.

BACKGROUND OF THE INVENTION

In most fuel supply systems applicable to internal combustion engines, fuel injectors are used to direct fuel pulses into the engine combustion chamber. Fuel injection into the cylinders of an internal combustion engine is most commonly achieved using either a unit injector system or a fuel distribution type system. In the unit injector system, fuel is pumped from a source by way of a low pressure rotary pump or gear pump to high pressure pumps, known as unit injectors, associated with corresponding engine cylinders for increasing the fuel pressure while providing a finely atomized fuel spray into the combustion chamber. Such unit injectors conventionally includes a positive displacement plunger driven by a cam which is mounted on an engine driven cam shaft. The fuel distribution type system, on the other hand, supplies high pressure fuel to injectors which do not pump the fuel but only direct and atomize the fuel spray into the combustion chamber.

A commonly used injector in both the unit and fuel distribution systems is a closed-nozzle injector. Closed-nozzle injectors include a nozzle assembly having a spring-biased nozzle valve element positioned adjacent the nozzle orifice for resisting blow back of exhaust gas into the pumping or metering chamber of the injector while allowing fuel to be injected into the cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by nozzle spring to block the nozzle orifices. When the pressure of the fuel within the nozzle cavity exceeds the biasing force of the nozzle spring, the nozzle valve element moves outwardly to allow fuel to pass through the nozzle orifices.

Internal combustion engine designers have increasingly come to realize that substantially improved fuel supply systems are required in order to meet the ever increasing governmental and regulatory requirements of emissions abatement and increased fuel economy. It is well known that the level of emissions generated by the diesel fuel combustion process can be reduced by decreasing the volume of fuel injected during the initial stage of an injection event while permitting a subsequent unrestricted injection flow rate. As a result, many proposals have been made to provide injection rate control devices or modifications in or adjacent to the fuel injector nozzle assemblies. One method of controlling the initial rate of fuel injection is to spill a portion of the fuel to be injected during the injection event. For example, U.S. Pat. Nos. 4,811,715 to Djordjevic et at. and 3,747,857 to Fenne each disclose a fuel delivery system for supplying fuel to a closed nozzle injector which includes an expandable chamber for receiving a portion of the high pressure fuel to be injected. The diversion or spilling of injection fuel during the initial portion of an injection event decreases the quantity of fuel injected during this initial period thus controlling the rate of fuel injection. A subsequent unrestricted injection flow rate is achieved when the expandable chamber becomes filled causing a dramatic increase in the fuel pressure in the nozzle cavity. Therefore these devices rely on the volume of the expandable chamber to determine the beginning of the unrestricted flow rate. Moreover, the use of a separate expandable chamber device mounted on or near an injector increases the costs, size and complexity of the injector. U.S. Pat. No. 5,029,568 to Perr discloses a similar injection rate control device for an open nozzle injector.

U.S. Pat. Nos. 4,804,143 to Thomas and 2,959,360 to Nichols disclose other fuel injector nozzle assemblies incorporating passages in the nozzle assembly for diverting the fuel from the nozzle assembly. The injection nozzle unit disclosed in Thomas includes a restricted passage formed in the injector adjacent the nozzle valve element for directing fuel from the nozzle cavity to a fuel outlet circuit. However, the restricted passage is used to maintain fuel flow through the nozzle unit so as to effect cooling. The Thomas patent nowhere discusses or suggests the desirability of controlling the injection rate. Moreover, the restricted passage is closed by the nozzle valve element upon movement from its seated position to prevent diverted flow during injection. The fuel injector disclosed in Nichols includes a nozzle valve element having an axial passage formed therein for diverting fuel from the nozzle cavity into an expansible chamber formed in the nozzle valve element. A plunger is positioned in the chamber to form a differential surface creating a fuel pressure induced seating force on the nozzle valve element to aid in rapidly seating the valve element. The Nichols reference does not suggest the desirability of controlling the rate of injection.

U.S. Pat. No. 4,993,926 to Cavanagh discloses a fuel pumping apparatus including a piston having a passage formed therein for connecting a chamber to an annular groove for spilling fuel during an initial portion of an injection event. The piston includes a land which blocks the spill of fuel after the initial injection stage to permit the entirety of the fuel to be injected into the engine cylinder. However, this device is incorporated into a piston pump positioned upstream from an injector.

Another method of reducing the initial volume of fuel injected during each injection event is to reduce the pressure of the fuel delivered to the nozzle cavity during the initial stage of injection. For example, U.S. Pat. No. 5,020,500 to Kelly discloses a closed nozzle injector including a passage formed between the nozzle valve element and the inner surface of the nozzle cavity for restricting or throttling fuel flow to the nozzle cavity so as to provide rate shaping capability. U.S. Pat. No. 4,258,883 issued to Hoffman et at. discloses a similar fuel injection nozzle including a throttle passage formed between the nozzle valve element and a separate control supply valve for restricting fuel flow into the nozzle cavity thus limiting the pressure increase in the cavity and the rate of injection fuel flow through the injector orifices. However, the devices disclosed in both Kelly and Hoffman et at. require extremely close manufacturing tolerances which must be carefully controlled to create a throttling passage having the precise dimensions necessary to achieve effective, predictable rate shaping. As a result, because of the great difficulty associated with holding very close manufacturing tolerances, these devices greatly increase manufacturing costs. Moreover, this tolerance problem makes the production of fuel injectors having substantially identical characteristics both technically and economically unfeasible.

U.S. Pat. Nos. 3,669,360 issued to Knight, 3,747,857 issued to Fenne, and 3,817,456 issued to Schlappkohl all disclose closed nozzle injector assemblies including a high pressure delivery passage for directing high pressure fuel to the nozzle cavity of the injector and a throttling orifice positioned in the delivery passage for creating an initial low rate of injection. Moreover, the devices disclosed in Knight and Schlappkohl include a valve means operatively connected to the nozzle valve element which provides a substantially unrestricted flow of fuel to the nozzle cavity upon movement of the nozzle valve element a predetermined distance off its seat.

U.S. Pat. Nos. 3,718,283 issued to Fenne and 4,889,288 issued to Gaskell disclose fuel injection nozzle assemblies including other forms of rate shaping devices. For example, Fenne '283 uses a multi-plunger and multi-spring arrangement to create a two-stage rate shaped injection. The Gaskell reference uses a damping chamber filled with a damping fluid for restricting the movement of the nozzle valve element.

Although the systems discussed hereinabove create different stages of injection, further improvement is desirable. None of the above discussed references disclose a fuel injector incorporating a simple, cost effective rate shaping device which minimizes the complexity of the nozzle assembly while effectively controlling emissions by controlling the rate of fuel injection.

SUMMARY OF THE INVENTION

It is an object of the present invention, therefore, to overcome the disadvantages of the prior art and to provide an improved nozzle assembly for a fuel injector which effectively controls the flow rate of fuel injected into the combustion chamber of an engine so as to minimize engine emissions.

It is another object of the present invention to provide a nozzle assembly capable of shaping the rate of fuel injection which is also simple and inexpensive to manufacture.

It is yet another object of the present invention to provide a rate shaping nozzle assembly for an injector which effectively slows down the rate of fuel injection during the initial portion of an injection event while subsequently increasing the rate of injection to rapidly achieve a high injection pressure.

It is a further object of the present invention to provide a rate shaping nozzle assembly for an injector used in a pump-fine-nozzle fuel system to effectively control the rate of injection at each cylinder location.

It is a still further object of the present invention to provide a rate shaping nozzle assembly for an injector which permits rapid closing of the nozzle valve element at the end of the injection event to minimize the amount of low pressure fuel delivered at the end of the event thereby providing a sharper end of injection.

Still another object of the present invention is to provide a rate shaping nozzle assembly for an injector which includes a spill circuit through which fuel flow is prevented when the nozzle valve element is closed between injection events.

Yet another object of the present invention is to provide a compact closed nozzle assembly for an injector which slows down the opening of the nozzle valve element while maintaining high injection pressures and short injection durations.

A further object of the present invention is to provide a rate shaping nozzle assembly for an injector which includes a spill circuit and a spill valve capable of effectively controlling the flow of spill fuel.

Another object of the present invention is to provide a rate shaping assembly having a spill circuit which effectively control the rate of fuel injection while preventing the accumulation of gas or air bubbles in the spill circuit.

These and other objects are achieved by providing a closed nozzle fuel injector comprising an injector body containing an injector cavity communicating with an injector orifice for discharging fuel into a combustion chamber wherein the injector body includes a fuel transfer circuit for transferring supply fuel to the orifice and a low pressure drain circuit for draining fuel from the injector cavity. A nozzle valve element positioned in the injector cavity adjacent the injector orifice is movable between an open position in which fuel may flow from the transfer circuit through the orifice into the combustion chamber, and a closed position in which fuel flow through the injector orifice is blocked. The nozzle valve element moves from the closed position to the open position and back to the closed position to define an injection event. The injector includes a rate shaping control device for producing a predetermined time varying change in the flow rate of fuel injected into the combustion chamber during the injection event. The rate shaping control device includes an injection spill circuit for spilling a portion of the injection fuel from the transfer circuit to the low pressure drain circuit during the injection event. The spill circuit includes a spill passage integrally formed in the nozzle valve element. The rate shaping control device may also include a flow limiting orifice positioned along the spill circuit for limiting the spill flow through the spill circuit to a predetermined maximum spill flow rate. The rate shaping control means may also include a spill valve for controlling the spill flow of fuel through the spill circuit to create a low injection rate followed by a high injection flow rate. A spill valve may be movable into a spill position to permit spill fuel flow through the spill circuit to create the low injection rate, and into a blocking position to prevent spill flow through the spill circuit so as to create a high injection rate following the low injection rate. A spill valve means is movable into the spill position upon movement of the movable valve element towards the closed position to minimize the time necessary for the nozzle valve element to move into the closed position.

The injector may also include a nozzle cavity positioned adjacent the injector orifice for housing the nozzle valve element and accumulating fuel for injection. The spill passage may include a first end opening into the nozzle cavity. The spill circuit may include an outer annular groove formed in the nozzle valve element a spaced distance along the element from the first end of the spill passage, and also an inner annular groove formed in the injector body for registration with the outer annular groove. The spill valve may include a movable valve land integrally formed on the nozzle valve element adjacent the outer annular groove. The land may be movable into a blocking position upon movement of the needle valve element from the closed position toward the open position to prevent the spill flow of fuel through the spill circuit.

In another embodiment, the spill valve may include a movable valve land integrally formed on the nozzle valve element adjacent the first end of the spill passage. The integral valve land is movable into a blocking position upon movement of the needle valve from the closed position to the open position to prevent spill flow between the nozzle cavity and the spill passage. The spill passage may include a transverse passage extending transversely through the nozzle valve element and opening into the nozzle cavity when the nozzle valve element is in the closed position.

The injector may include a biasing spring operatively connected to the nozzle valve element for biasing the element into the closed position. The biasing spring is positioned in a spring cavity forming a portion of the spill circuit.

In the preferred embodiment, the nozzle valve element blocks fuel flow through the spill circuit when the valve element is positioned in the closed position. The nozzle valve element may include an inner end positioned adjacent the injector orifice and an outer end positioned a spaced distance from the inner end. The spill passage may include an axial passage extending from the inner end along a central longitudinal axis of the nozzle valve element toward the outer end. A valve surface may be formed on the inner end of the nozzle valve element and is designed to engage a corresponding valve seat formed on the injector body adjacent the injector orifice when the nozzle valve element is in the closed position so as to block fuel flow from the nozzle cavity to the spill passage and the injector orifice. The spill circuit may include an annular recess formed in the injector body adjacent the nozzle valve element and a lateral passage providing fluidic communication between the axial passage and the annular recess. The flow limiting orifice may be formed in the lateral passage which is formed in the nozzle valve element. The spill valve may include an annular step integrally formed on the nozzle valve element and an annular valve seat formed on the injector body for sealing engagement by the step upon movement of the nozzle valve element into the open position to prevent spill flow through the spill circuit.

The rate shaping control device may include a spill accelerating device positioned along the spill circuit for creating a rapid increase in the spill flow rate during each injection event. The spill accelerating device may include a spill chamber formed in the nozzle valve element for receiving spill fuel from the spill passage. The spill chamber includes a transverse cross sectional area greater than the transverse cross sectional area of the spill passage upstream of the spill chamber so as to provide an accumulation chamber for insuring adequate spill flow. The spill valve may include an annular valve seat formed on the injector body and a movable body valve member having a convex seal surface for intermittently engaging the annular valve seat to block the spill flow through the spill circuit. The movable valve member may be spherically shaped to form a ball-type valve.

In another embodiment of the present invention, the rate shaping control device may include a throttling passage integrally formed in the nozzle valve element for restricting the flow of fuel to the nozzle cavity to thereby vary the rate at which fuel pressure in the nozzle cavity increases. The transfer circuit may include an unrestricted delivery passage for permitting unrestricted fuel flow to the nozzle cavity. The rate shaping control device may include a flow control valve for controlling the flow of fuel through the unrestricted delivery passage. The flow control valve includes a valve land integrally formed on the nozzle valve element and movable into a blocking position preventing fuel flow through the unrestricted delivery passage when the nozzle valve element is positioned in the closed position.

DETAILED DESCRIPTION OF THE PREFERRED EMBODIMENT

Figure 1A:
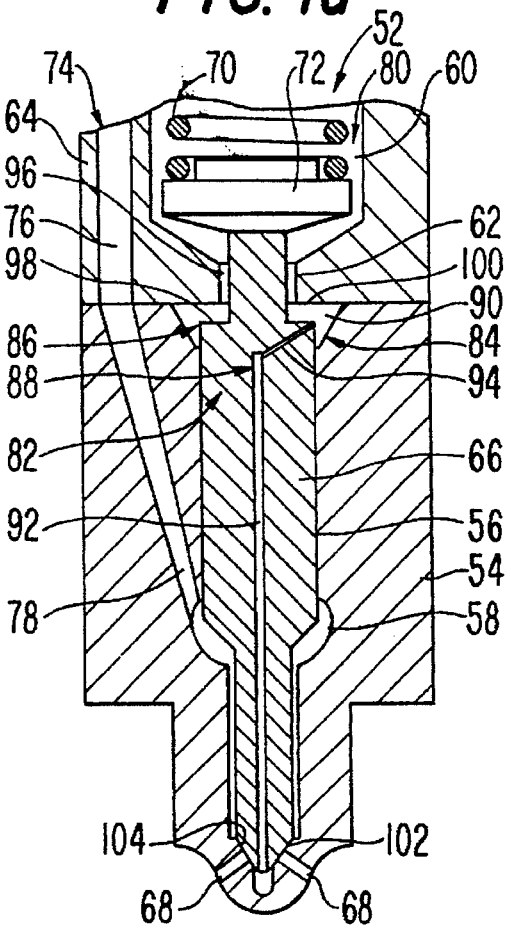
FIG. 1*a* is an enlarged, partial cross-sectional view of the nozzle assembly of a closed nozzle fuel injector incorporating the rate shaping control device of the present invention wherein the nozzle valve element is positioned in the closed position.

Throughout this application, the words "inward", "innermost", "outward", and "outermost" will correspond to the directions, respectively, forward and away from the point at which fuel from an injector is actually injected into the combustion chamber of the engine. The words "outer" and "inner" will refer to the portions of the injector or nozzle assembly which are, respectively, farthest away and closest to the engine cylinder when the injector is operatively mounted on the engine.

FIGS. 1–7 disclose various embodiments of the rate shaping nozzle assembly of the present invention for use in fuel injectors of various types. For instance, referring to FIG. 9, there is shown a conventional fuel injector 10 designed to receive high pressure fuel from a high pressure source (not shown) via a delivery line 12. The high pressure source or system delivering the high pressure fuel to the injector may be a pump-line-nozzle system including one or more high pressure pumps and/or a high pressure accumulator and/or a fuel distributor. Injector 10 generally includes an injector body 14 formed from an outer barrel 16, an inner barrel 18, a nozzle housing 20 and a retainer 22. The inner barrel 18 and nozzle housing 20 are held in a compressive buffing relationship in the interior of retainer 22 by outer barrel 16. The outer end of retainer 22 contains internal threads for engaging corresponding external threads on the lower end of outer barrel 16 to permit the entire injector body 14 to be held together by simple relative rotation of retainer 22 with respect to outer barrel 16.

As is well known, injector body 14 includes an injector cavity indicated generally at 24 which includes a spring cavity 26 formed in outer barrel 16, a nozzle valve element bore 26 formed in the inner barrel 18 and nozzle housing 20, and a nozzle cavity 28 formed in the lower end of nozzle housing 20. The injector body 14 includes a fuel transfer circuit 30 comprised of delivery passages 32 and 34 formed in body 14, and transfer passages 36 and 38 formed in inner barrel 18 and nozzle housing 20 respectively, for delivering fuel from delivery line 12 to nozzle cavity 28. Injector body 14 also includes one or more injector orifices 40 fluidically connecting nozzle cavity 28 with a combustion chamber of an engine (not shown).

Fuel injector 10 also includes a nozzle valve element 42 slidably received in bore 26 and extending into nozzle cavity 28. A biasing spring 44 positioned in spring cavity 26 abuts the outer end of nozzle valve element 42 via a connector button 46 so as to bias the inner end of nozzle valve element 42 into a closed position blocking fuel flow through injector orifices 40. Injector body 14 also includes a low pressure drain circuit including spring cavity 26 and a drain passage 50. Any fuel leaking through the slight clearance between nozzle valve element 42 and bore 26 will be directed to a low pressure drain via cavity 26 and drain passage 50.

Figure 9:
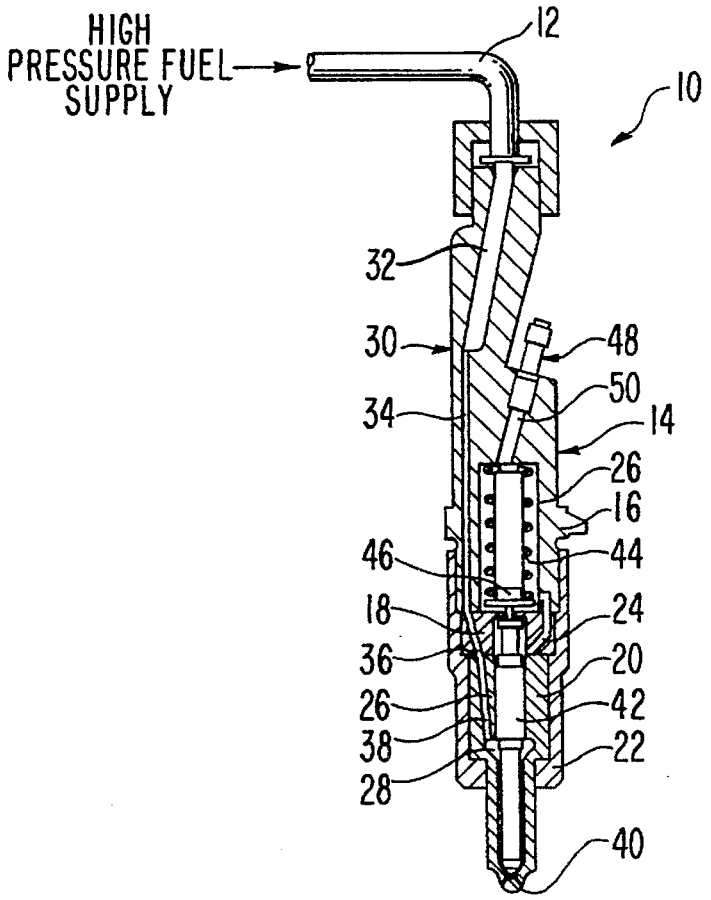
FIG. 9 is a cross-sectional view of a prior art fuel injector having a conventional closed nozzle assembly.

The rate shaping nozzle assembly of the present invention as described hereinbelow can be adapted for use with a variety of injectors and, therefore, is not limited to the injector disclosed in FIG. 9. The conventional injector of FIG. 9 is merely shown as representative of the type of injector in which the present invention may be advantageously incorporated. The rate shaping nozzle assembly of the present invention can certainly be incorporated into other forms of injectors including a unit injector having a high pressure pump plunger incorporated into the injector body.

Figure 1B:
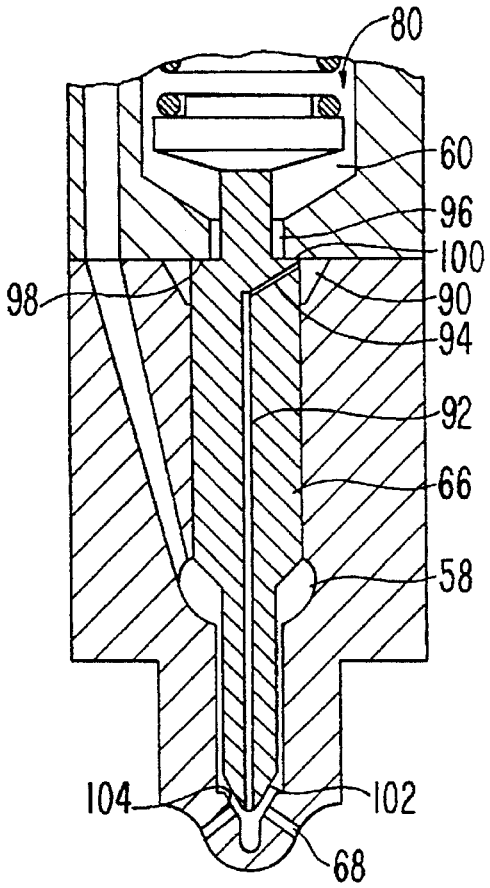
FIG. 1*b* is an enlarged, partial cross-sectional view of the rate shaping nozzle assembly of FIG. 1*a* with the nozzle valve element positioned in the open position.
Figure 2:
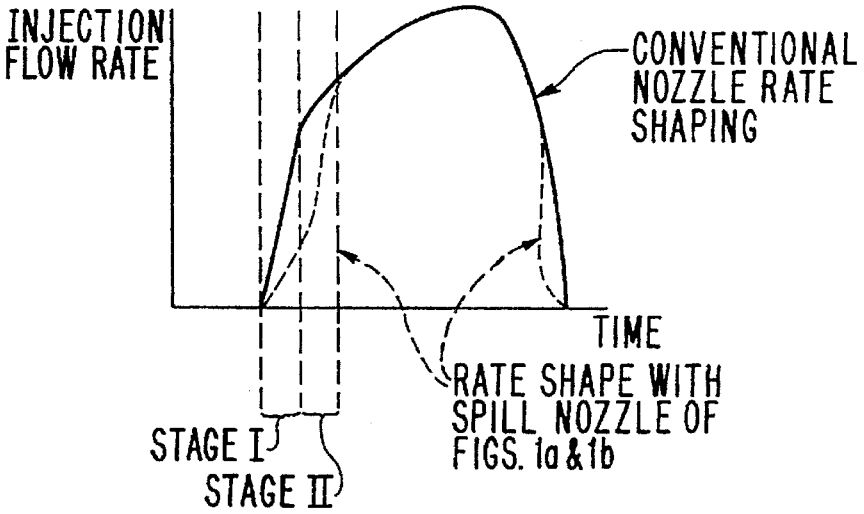
FIG. 2 is a graph showing the injection rate as a function of time during an injection event using the injection rate shaping nozzle assembly of FIGS. 1*a* and 1*b;*

Now referring to FIGS. 1*a* and 1*b*, there is shown the rate shaping nozzle assembly of the present invention indicated generally at 52 which includes a nozzle housing 54 containing a nozzle bore 56 opening into a nozzle cavity 58 at one end. The opposite end of nozzle bore 56 communicates with a spring cavity 60 via a through-hole 62 formed in, for example, an inner barrel 64. Although not shown, a conventional retainer is used to hold the inner barrel and nozzle housing 54 in compressive abutting relationship similar to the injector shown in FIG. 9. Received in nozzle bore 56 is a nozzle valve element 66 sized to form a close sliding fit with the inside surface of bore 56 creating a fluid seal which substantially prevents fluid from leaking from the clearance between nozzle valve element 66 and the inner surface of bore 56. Nozzle valve element 66 is biased into the closed position blocking flow through injector orifices 68 by a biasing spring 70 positioned in spring cavity 60. A connector button 72 functions as a spring seat and also to transmit the spring force to the outer end of nozzle valve element 66. A fuel transfer circuit 74 includes transfer passages 76 and 78 formed in the inner barrel and nozzle housing, respectively, for delivering high pressure fuel from a high pressure source (not shown) to nozzle cavity 58. A low pressure drain circuit 80, as discussed with reference to FIG. 9 hereinabove, communicates with spring cavity 60 to provide a drain path for fuel leakage into spring cavity 60.

Rate shaping nozzle assembly 52 includes a rate shaping control device indicated generally at 82 which includes an injection spill circuit 84 and a spill valve 86. Injection spill circuit 84 includes a spill passage 88 formed integrally in, and extending through, nozzle valve element 66. Injection spill circuit 84 also includes an annular recess 90, through-hole 62, and spring cavity 60. Spill passage 88 includes an axial passage 92 extending from the inner end of nozzle valve element 66, along a central longitudinal axis of nozzle valve element 66, and terminating prior to the outer end of valve element 66. Spill passage 88 also includes a lateral passage 94 extending from the outer end of axial passage 92 to communicate with annular recess 90. Annular recess 90 communicates with spring cavity 60 via an annular clearance 96 formed between the outer end of valve element 66 and through-hole 62. Lateral passage 94 is sized to function as a flow limiting orifice so as to throttle the flow through injection spill circuit 84. Axial passage 92 and lateral passage 94 may be formed by drilling or electrical discharge machining the passages into a fully hardened and finished nozzle element.

Spill valve 86 includes an annular step 98 formed on nozzle valve element 66 adjacent annular recess 90. Spill valve 86 also includes an annular valve seat 100 formed opposite step 98 on inner barrel 64. When nozzle valve element 66 is in a closed position as shown in FIG. 1*a* blocking fuel flow through injector orifices 68, annular step 98 is positioned a spaced distance from annular valve seat 100 to provide a spill flow path from annular recess 90 to spring cavity 60 via clearance gap 96. However, during an injection event, when nozzle valve element 66 moves to a fully open position shown in FIG. 1*b*, annular step 98 sealingly engages annular valve seat 100 to prevent spill flow between annular recess 90 and spring cavity 60. Spill passage 88 is formed in nozzle valve element 66 so that the conventional valve arrangement formed on the inner end of element 66 can be used as a spill valve. Specifically, the inner end of nozzle valve element 66 includes a valve surface 102 for sealingly engaging a valve seat 104 formed on the inner surface of nozzle cavity 58 upstream of injector orifices 68. The inner end of axial passage 92 opens relative to valve seat 104 so that nozzle valve element 66 blocks fuel flow from nozzle cavity 58 to axial passage 92 when nozzle valve element 66 is in the closed position against valve seat 104. As a result, no spill fuel flows through spill passage 88 between injection events.

During operation, between injection events, nozzle valve element 66 is positioned in the closed position as shown in FIG. 1*a* blocking flow through injector orifices 68 and injection spill circuit 84. At the start of an injection event, high pressure fuel is delivered from fuel transfer circuit 74 to nozzle cavity 58. When the pressure of the fuel in nozzle cavity 58 reaches a predetermined maximum necessary to overcome the biasing force of spring 70, nozzle valve element 66 begins to lift off valve seat 104 permitting fuel flow from nozzle cavity 58 through fuel injector orifices 68 into the combustion chamber of an engine. Fuel also spills into axial passage 92 traveling outwardly through lateral passage 94 into annular recess 90. During the initial outward movement of the nozzle valve element 66, annular step 98 is still positioned a spaced distance from annular valve seat 100. As a result, fuel flowing into annular recess 90 is permitted to spill through clearance gap 96 into spring cavity 60 and on to the low pressure drain (not shown) connected to spring cavity 60.

Therefore, with the present rate shaping nozzle assembly 52, a portion of the fuel normally flowing through injector orifices 68 is instead directed into spill passage 88. This splitting of the fuel flow into an injection flow and a spill flow during the initial portion of the injection event creates a reduced or low injection rate as represented by Stage I in FIG. 2. The size of the orifice formed in lateral passage 94 or, alternatively, the diameter of lateral passage 94, determines the maximum spill rate to the low pressure drain and thus controls the injection rate through orifices 68. Further outward movement of nozzle valve element 66 into a fully opened position as shown in FIG. 1*b*, causes annular step 98 to sealingly engage annular valve seat 100 blocking fluidic communication between annular recess 90 and annular clearance 96. Thus, once nozzle valve element 66 moves into the fully opened position, spill flow through injection spill circuit 84 is prevented thereby permitting full fuel flow through injector orifices 68. As indicated by Stage II in FIG. 2, blockage of the spill flow causes the injection flow rate through injector orifices 68 to rapidly increase.

At the end of the injection event, when the delivery of high pressure fuel to nozzle cavity 58 has ceased, nozzle valve element 66 begins to move inwardly toward the closed position shown in FIG. 1*a*. During this inward movement, annular step 98 moves away from valve seat 100 permitting spill flow of pressurized fuel from nozzle cavity 58 through injection spill circuit 84. This creation of an additional drain or spill path during the last portion of the injection event causes a rapid decrease in the injection flow rate through orifices 68 since a portion of the fuel is directed through spill circuit 84. This end of injection spill advantageously creates a sharper end to the injection event.

Referring now to FIGS. 3*a*–3*d*, alternative embodiments of the nozzle valve element used in rate shaping nozzle assembly 52 of FIGS. 1*a* and 1*b* are shown. It has been found that spill flow through axial passage 92 may be inadequate under certain conditions given the short duration of an injection event and the minimal size of axial passage 92. The embodiments shown in FIGS. 3*a*–3*d* all include means for accelerating the spill flow through axial passage 92 so as to insure sufficient spill flow necessary to reduce the injection flow rate through orifices 68.

Figure 3A:
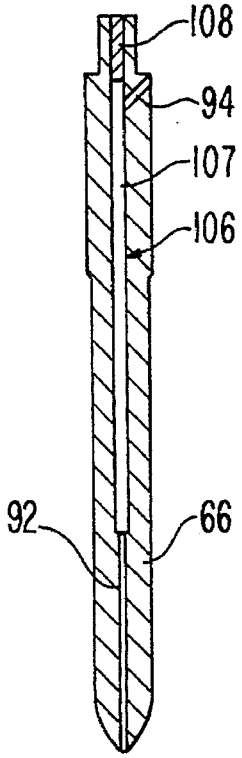
FIGS. 3*a*–3*d* are cross-sectional views of various embodiments of nozzle valve elements used in the rate shaping control device shown in FIGS. 1*a* and 1*b;*

As shown in FIG. 3*a*, a spill accelerating device 106 may include a second axial passage 107 having a larger diameter than axial passage 92. The axial passages may be formed by electrical discharge machining from the outer end of nozzle valve element 66. The larger diameter of second axial passage 107 results in a larger cross sectional flow area and thus a larger volume for receiving spill fuel from axial passage 92. Consequently, this combination of axial passages 92 and 107 creates less impediment to spill flow than the embodiment of FIG. 1*a*. The outer end of second axial passage 107 may be closed with a plug 108 securely positioned in the end of second axial passage 107 by, for example, an interference fit, after heat treating nozzle valve element 66. Alternatively, plug 108 could be positioned in second axial passage 107 prior to heat treatment to allow the heat treatment process to create a secure fit.

Figure 3B:
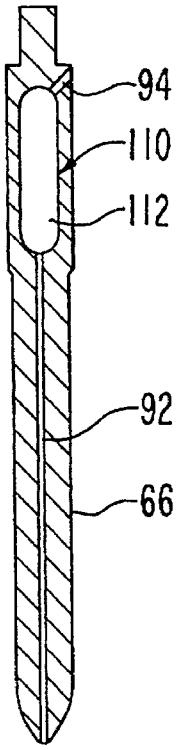

FIG. 3*b* discloses another embodiment of the nozzle valve element 66 including a spill accelerating device 110 including a relatively large volume spill chamber 112 positioned at the outer end of axial passage 92 between lateral passage 94 and axial passage 92. Spill chamber 112 functions similarly to second axial passage 107 to increase the spill flow during the initial portion of the injection event so as to insure adequate spill flow to reduce the injection flow rate through orifices 68 by an amount necessary to enhance combustion and minimize emissions.

Figure 3C:
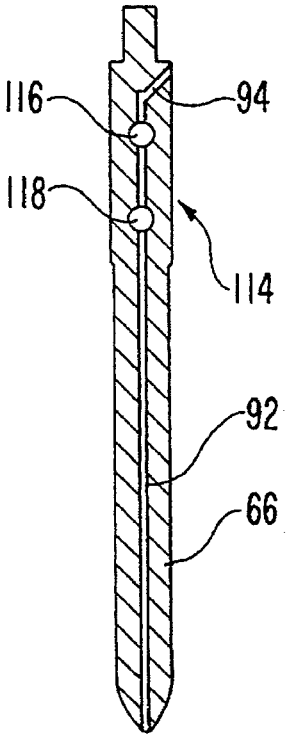

FIG. 3*c* discloses yet another embodiment of nozzle valve element 66 incorporating a spill accelerating device 114 in the form of two cross drillings, 116, 118 extending transversely through nozzle valve element 66 and communicating with axial passage 92. The insertion of nozzle valve element 66 into nozzle housing 54 permits nozzle bore 56 to close the openings of drillings 116 and 118 so as to seal the injection spill circuit. Cross drillings 116 and 118 function as spill chambers similar to spill chamber 112 of FIG. 3*b*. In addition, it has been found that spill chambers or drillings 116, 118 effectively minimize the formation of air or gas pockets resulting from the accumulation of gas in the spill circuit. Such gas pockets have been found to disadvantageously reduce the flow through axial passage 92 impairing the performance of rate shaping nozzle assembly 52.

Figure 3D:
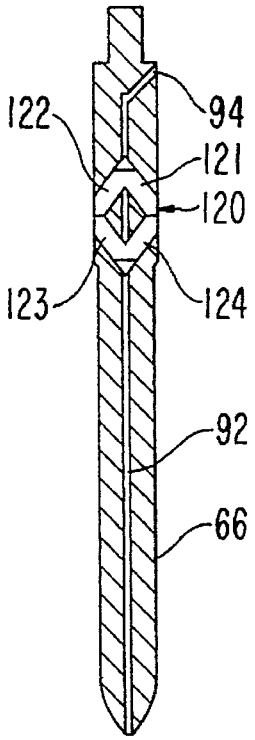

FIG. 3*d* discloses yet another embodiment of nozzle valve element 66 including a spill accelerating device 120 comprised of four angled drillings 121–124 communicating with axial passage 92 and opening onto the outer surface of nozzle valve element 92. Passages 123 and 124 are angled to receive spill flow from axial passage 92 and direct the flow outwardly into passages 122 and 121 respectively. Passages 122 and 121 angle inwardly toward the central axis of nozzle valve element 66 to direct the spill flow back into axial passage 92. Since passages 121–124 communicate with nozzle bore 56, this embodiment also effectively permits the formation of gas pockets along axial passage 92.

The spill flow rate, and therefore the injection flow rate, can be controlled by forming the spill passages in the nozzle valve element with a specific total volume necessary to create the desired spill flow rate. The easiest and most practical manner in which to establish the total spill volume is to control the size of the spill accelerating device, i.e. axial passage 107, spill chamber 112, cross drillings 116, 118 and angled drillings 121–124. The Table shows volumetric values for each of the spill accelerating devices which have been found to produce spill flow rates particularly advantageous in creating optimum injection rate shaping.

TABLE

| | NOZZLE VALVE EMBODIMENT VOLUME ($mm^3$) | | | | | |
|---|---|---|---|---|---|---|
| | | FIG. 3a | | | | |
| SPILL PASSAGE | FIGS. 1a & 1b | Design No. 1 | Design No. 2 | FIG. 3b | FIG. 3c | FIG. 3d |
| AXIAL PASSAGE | 8.310 | 2.838 | 1.013 | 6.283 | 7.702 | 8.310 |
| LATERAL PASSAGE | 0.557 | 0.507 | 0.507 | 0.405 | 0.557 | 0.557 |
| SPILL ACCELERATING DEVICE | N/A | 17.846 | 22.656 | 47.451 | 14.137 | 14.840 |
| TOTAL VOLUME | 8.867 | 21.190 | 24.176 | 54.140 | 22.396 | 23.727 |

Figure 4A:
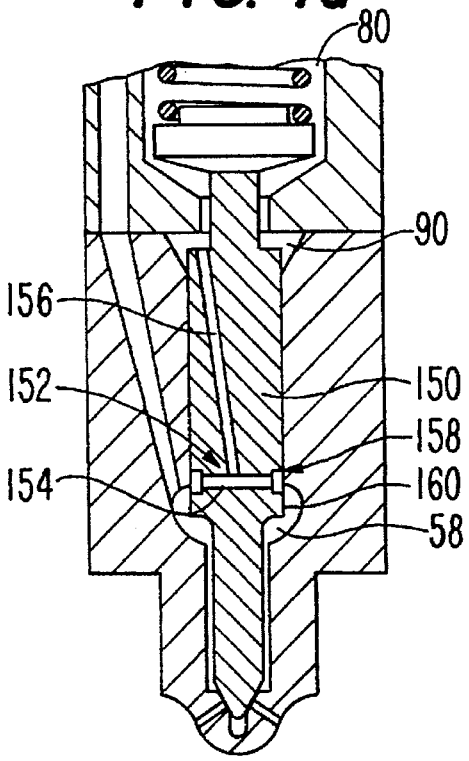
FIG. 4*a* is an enlarged, partial cross-sectional view of an alternative embodiment of the present invention with the nozzle valve element positioned in the closed position.
Figure 4B:
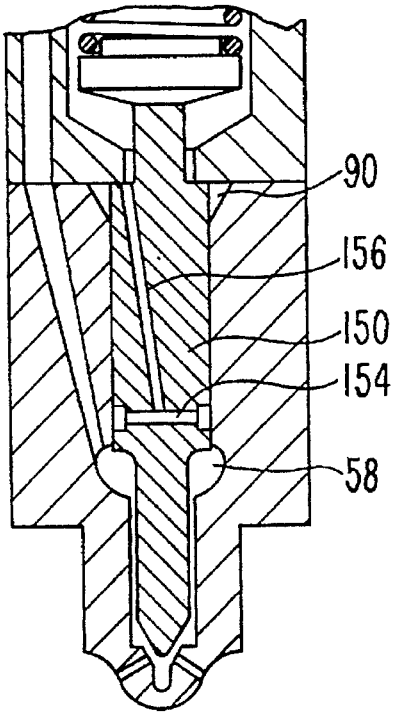
FIG. 4*b* is an enlarged, partial cross-sectional view of the nozzle assembly of FIG. 4*a* with the nozzle valve element in the open position.

FIGS. 4*a* and 4*b* represent another embodiment of the rate shaping nozzle assembly of the present invention which includes a nozzle valve element 150 having an integral spill passage 152 formed therein which remains in fluidic communication with nozzle cavity 58 when nozzle valve element 150 is in the closed position as shown in FIG. 4*a*. Spill passage 152 includes a transverse passage 154 extending through nozzle valve element 150 and positioned along the axial length of element 150 so as to communicate with nozzle cavity 58 at both ends when valve element 150 is in the closed position. Spill passage 152 also includes an axial spill passage 156 extending from transverse spill passage 154 outwardly through nozzle valve element 150 to communicate with annular recess 90. A spill valve device 158 for controlling the flow of spill fuel through transverse spill passage 154 includes an annular valve land 160 formed on nozzle valve element 150 adjacent to, and inward of, transverse passage 154. During the initial movement of nozzle valve element 150 toward the open position, injection fuel is spilled from nozzle cavity 58 to low pressure drain 80 via transverse passage 154, axial passage 156 and annular recess 90 similar to the embodiment of FIGS. 1*a* and 1*b*. At a predetermined point during the movement of nozzle valve element 150 towards the open position, valve land 160 blocks communication between transverse passage 154 and nozzle cavity 58 stopping the spill flow of fuel. When nozzle valve element 150 moves toward the closed position during the last portion of the injection event, valve land 160 moves to permit fluidic communication between nozzle cavity 58 and transverse passage 154 thereby relieving pressure in nozzle cavity 58 to cause a sharp end to injection. The resulting injection rate shape during the injection event is similar to that shown in FIG. 2.

Figure 5A:
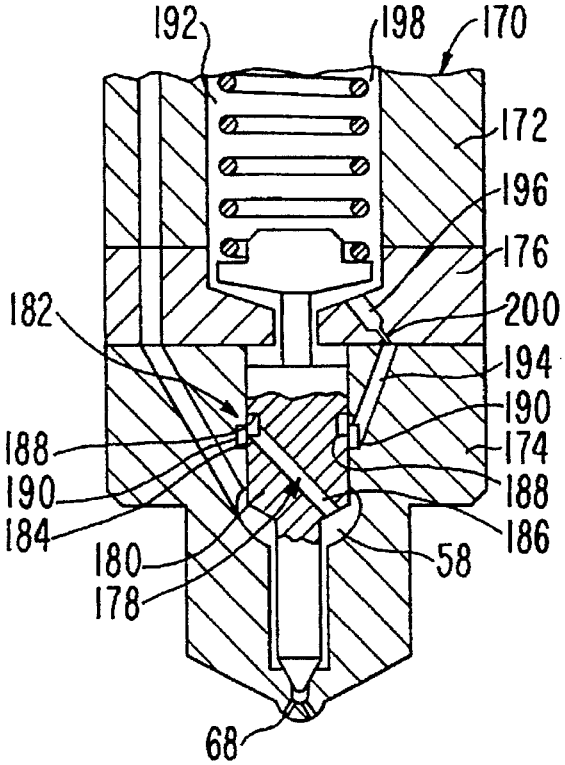
FIG. 5*a* is a partial cross sectional view of another embodiment of the rate shaping nozzle assembly of the present invention with the nozzle valve element positioned in the closed position.
Figure 5B:
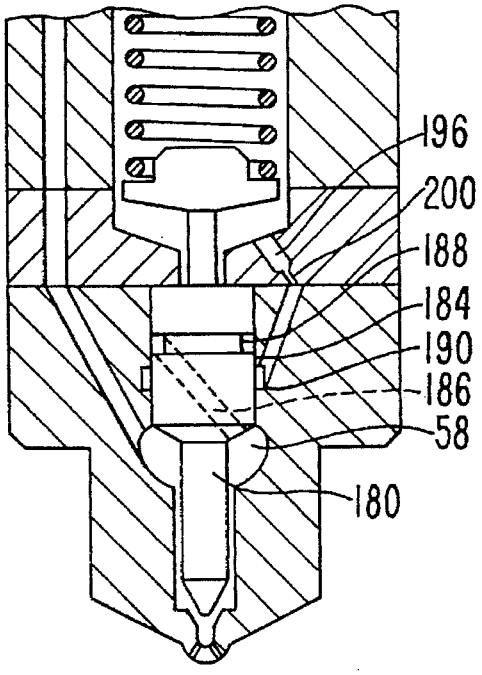
FIG. 5*b* is a partial cross sectional view of the rate shaping nozzle assembly of FIG. 5*a* with the nozzle valve element positioned in the open position.

FIGS. 5*a* and 5*b* disclose yet another embodiment of the spill-type rate shaping nozzle assembly of the present invention which includes a fuel injector 170 including an outer barrel 172, a nozzle housing 174, and an inner barrel 176 positioned in compressive abutting relationship between outer barrel 172 and nozzle housing 174. The present embodiment is similar to the previous embodiment of FIGS. 4*a* and 4*b* in that nozzle cavity 58 fluidically communicates with a low pressure drain via a spill passage 178 formed integrally in a nozzle valve element 180. Moreover, the present embodiment includes a spill valve 182 including a movable valve land 184 integrally formed on nozzle valve element 180 which moves outwardly during movement of nozzle valve element 180 toward the open position, to block flow through spill passage 178. However, spill passage 178 includes a diagonal passage 186 extending transversely through nozzle valve element 180 outwardly from nozzle cavity 58. Diagonal passage 186 continuously communicates at an innermost end with nozzle cavity 58 and at an outermost end with an inner annular groove 188 formed in the outer surface of nozzle valve element 180 a spaced distance outwardly from nozzle cavity 58. An outer annular groove 190 formed in nozzle housing 174 registers with inner annular groove 188 when nozzle valve element 180 is positioned in the closed position as shown in FIG. 5*a*. A low pressure drain circuit 192 includes a first low pressure drain passage 194 formed in nozzle housing 174 and extending from outer annular groove 190. A second low pressure drain passage 196 extends through inner barrel 176 so as to fluidically connect low pressure drain passage 194 with a spring cavity 198 formed in both outer barrel 172 and inner barrel 176. Spring cavity 198 is connected to a low pressure drain (not shown) to form low pressure drain circuit 192. Second low pressure drain passage 196 includes a throttling orifice 200 sized to restrict the spill flow of fuel to a predetermined maximum flow rate. Similar to the previous embodiment, the present rate shaping control device permits spill flow to the low pressure drain circuit 192 when the nozzle valve element is in the closed position as shown in FIG. 5*a* and during a predetermined time period during the initial lift of nozzle valve element 180 from the closed to the open position of FIG. 5*b*. After nozzle valve element 180 has lifted a predetermined distance off its seat towards the open position, movable valve land 184 moves into a blocking position preventing flow through spill passage 178 thus causing full flow of injection fuel through orifices 68.

Figure 6A:
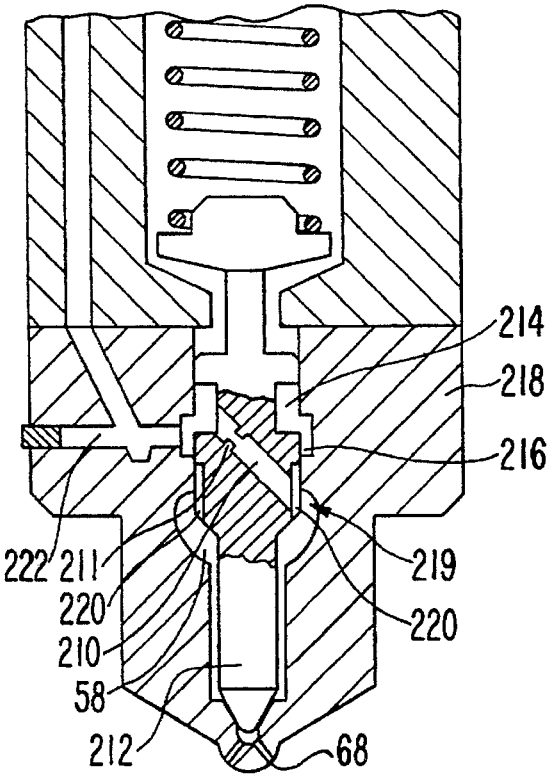
FIG. 6*a* is a partial cross-sectional view of a third embodiment of the present invention including a nozzle valve element, shown in the closed position, and including an integral throttling passage.
Figure 6B:
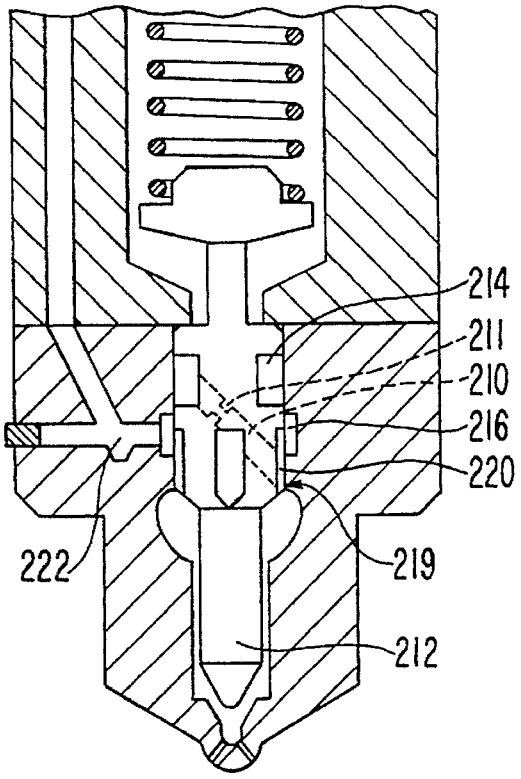
FIG. 6*b* is a partial cross-sectional view of the present invention shown in FIG. 6*a* with the nozzle valve element in the open position.

Referring now to FIGS. 6*a* and 6*b*, another embodiment of the present invention is shown which includes a rate shaping control device which, unlike the previous embodiments, does not spill fuel to be injected but instead restricts the flow of fuel to nozzle cavity 58 during the initial portion of the injection event. Specifically, a throttling passage 210 containing a throttling orifice 211 extends through nozzle valve element 212 to fluidically connect nozzle cavity 58 with an annular groove 214 formed in nozzle valve element 212. An annular land 216 formed on nozzle valve element 212 between annular groove 214 and nozzle cavity 58 forms a close sliding fit with the inner surface of nozzle housing 218 to form a fluid seal between nozzle valve element 212 and nozzle housing 218 when nozzle valve element 212 is in the closed position as shown in FIG. 6*a*. An unrestricted delivery passage indicated generally at 219 includes grooves 220 formed in the outer surface of nozzle valve element 212 and equally spaced around the circumference of nozzle valve element 212.

When nozzle valve element 212 is in the closed position as shown in FIG. 6*a*, annular land 216 blocks fuel flow from delivery passage 222 through grooves 220. As a result, supply fuel may only flow from delivery passage 222 into the nozzle cavity 58 via annular groove 214 and throttling passage 210. Once fuel pressure in nozzle cavity 58 reaches a predetermined level, nozzle valve element 212 begins to move outwardly off its seat to permit fuel to be injected through injector orifices 68. During this initial movement of nozzle valve element 212, throttling passage 210 functions to limit the rate of increase in injection pressure within nozzle cavity 58 thus limiting the injection flow through injector orifices 68 while controlling the lifting speed of nozzle valve element 212. Once nozzle valve element 212 lifts a predetermined distance from its seat, annular land 216 moves into a blocking position preventing fuel flow through throttling passage 210. As annular land 216 moves into the blocking position, grooves 220 are moved into fluidic communication with delivery passage 222 permitting supply fuel flow through grooves 220 into nozzle cavity 58. Grooves 220 are sized to permit full, unrestricted fuel flow into nozzle cavity 58 thereby permitting the injection pressure within nozzle cavity 58 to increase at a predetermined unrestricted rate. In this manner, throttling passage 210 controls the rate of increase in the pressure of the fuel in nozzle cavity 58 so as to control the injection rate of fuel through injector orifices 68.

Figure 7:
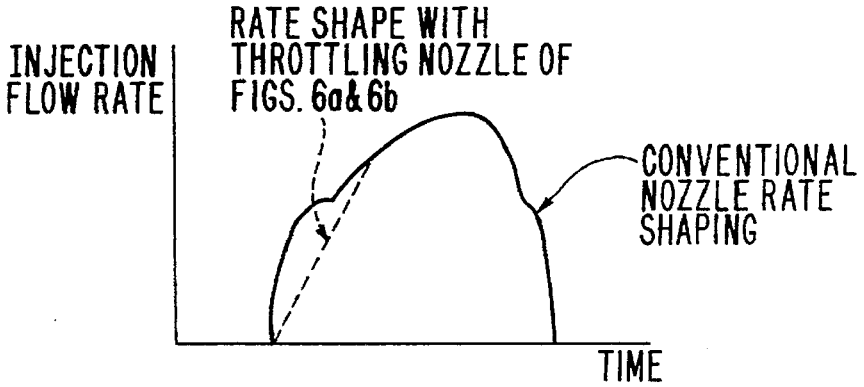
FIG. 7 is a graph showing the injection rate as a function of time during an injection event using the rate shaping control device of FIGS. 6*a* and 6*b;*

As shown in FIG. 7, the present rate shaping control device throttles the flow of fuel into nozzle cavity 58 so as to create a lower rate of fuel injection through orifices 68 during the initial portion of an injection event (indicated by dashed lines in FIG. 7) as compared to the initial injection rate shape of a conventional nozzle element (indicated by solid lines), such as the nozzle of FIG. 9.

Figure 8:
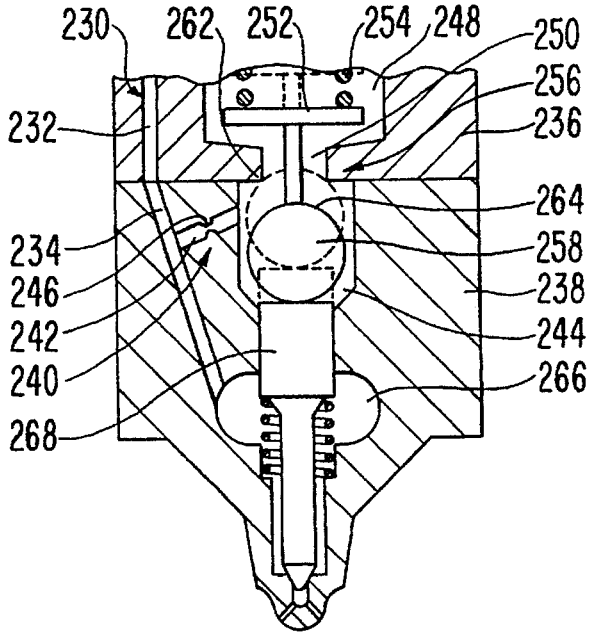
FIG. 8 is a fourth embodiment of the present invention including a spherical spill valve surface.

FIG. 8 illustrates yet another embodiment of the present invention which includes a spill-type rate shaping control device having a spill valve which effectively controls the flow of fuel through the spill circuit. A fuel transfer circuit 230 includes delivery passages 232 and 234 extending through injector barrel 236 and nozzle housing 238, respectively. A spill circuit 240 includes a spill passage 242 extending from delivery passage 234 through nozzle housing 238 to communicate with a spill valve cavity 234 formed in nozzle housing 238. Spill passage 242 includes a throttling orifice 246 for limiting the spill flow to a predetermined maximum flow rate. Spill valve cavity 244 fluidically communicates with spring cavity 248 via an opening 250 formed in the inner end of injector barrel 236. A connector button 252 functions as a spring seat for bias spring 254 and extends through opening 250. A spill valve 256 includes a spherical ball 258 positioned in spill valve cavity 244 and rigidly connected to the innermost end of connector button 252. The innermost end of spherical ball 258 abuts the outermost end of a nozzle valve element 260 permitting the spring force of spring 254 to bias valve element 260 into the closed position as shown. Spill valve 256 also includes an annular valve seat formed on injector barrel 236 around opening 250 for engagement by spherical ball 258. The outermost surface of spherical ball 258 includes a convex seal surface 264 for engaging annular valve seat 262 when the nozzle valve element 260 moves into the open position as represented by dashed lines in FIG. 8. Spill valve 256 operates similar to the spill valve 86 of FIGS. 1*a* and 1*b* to block the spill flow through spill circuit 240 upon movement of nozzle valve element 260 into the open position. However, convex seal surface 264 of spherical ball 258 insures that an effective fluid seal is formed with annular valve seat 262 so as to prevent leakage by valve seat 262 thereby insuring supply fuel delivery to nozzle cavity 266 without undesired spill flow. An inner spring 268, positioned around nozzle valve element 260 in nozzle cavity 266, is used to maintain nozzle valve element 260 in the open position against spherical ball 258 when the bias forces acting in opposite directions on nozzle valve element 260 are equal. Although the present convex seal surface 264 is shown incorporated in a rate shaping device including a spill passage formed in a nozzle housing, spherical ball 258 and convex seal surface 264 could be incorporated into the embodiments of FIGS. 1*a* and 1*b*.

INDUSTRIAL APPLICABILITY

It is understood that the present invention is applicable to all internal combustion engines utilizing a fuel injection system and to all closed nozzle injectors including unit injectors. This invention is particularly applicable to diesel engines which require accurate fuel injection rate control by a simple rate control device in order to minimize emissions. Such internal combustion engines including a fuel injector in accordance with the present invention can be widely used in all industrial fields and non-commercial applications, including trucks, passenger cars, industrial equipment, stationary power plant and others.

We claim:

1. A closed nozzle fuel injector adapted to inject fuel at high pressure into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice and a low pressure drain circuit for draining fuel from said injector cavity;

a nozzle valve element positioned in one end of said injector cavity adjacent said injector orifice, said nozzle valve element movable between an open position in which fuel may flow from said fuel transfer circuit through said injector orifice into the combustion chamber and a closed position in which fuel flow through said injector orifice is blocked, movement of said nozzle valve element from said closed position to said open position and from said open position to said closed position defining an injection event during which fuel may flow through said injector orifice into the combustion chamber;

a rate shaping control means for producing a predetermined time varying change in the flow rate of fuel injected into the combustion chamber during said injection event to create a low injection flow rate through said injector orifice followed by a high injection flow rate greater than said low injection flow rate during said injection event, said rate shaping control means including an injection spill circuit for spilling a portion of the fuel to be injected from said fuel transfer circuit to said low pressure drain circuit during said injection event, said spill circuit including a spill passage integrally formed in said nozzle valve element.

2. The closed nozzle fuel injector of claim 1, wherein said rate shaping control means further includes a flow limiting orifice positioned in said spill circuit for limiting the spill flow through said spill passage to a predetermined maximum spill flow rate.

3. The closed nozzle fuel injector of claim 2, wherein said flow limiting orifice is positioned in said spill passage.

4. The closed nozzle fuel injector of claim 1, wherein said rate shaping control means further includes a spill valve means for controlling the spill flow of fuel through said spill circuit to create said low injection flow rate through said injector orifice followed by said high injection flow rate.

5. The closed nozzle fuel injector of claim 4, wherein said spill valve means is movable into a spill position to permit spill fuel flow through said spill circuit to create said low injection rate and a blocking position to cream said high injection rate following said low injection rate, said spill valve means movable into said spill position upon movement of said movable valve element toward said closed position to minimize the time necessary for said nozzle valve element to move into said closed position.

6. The closed nozzle fuel injector of claim 4, further including a nozzle cavity positioned adjacent said injector orifice for housing said nozzle valve element and accumulating fuel for injection, said spill passage including a first end opening into said nozzle cavity.

7. The closed nozzle fuel injector of claim 6, wherein said spill circuit includes an outer annular groove formed in said nozzle valve element a spaced distance along said nozzle valve element from said first end of said spill passage and an inner annular groove formed in said injector body for registration with said outer annular groove, said spill valve means including a movable valve land integrally formed on said nozzle valve element adjacent said outer annular groove, said valve land movable into a blocking position upon movement of said needle valve element from said closed position toward said open position to prevent the spill flow of fuel through said spill circuit.

8. The closed nozzle fuel injector of claim 6, wherein said spill valve means includes a movable valve land integrally formed on said nozzle valve element adjacent said first end of said spill passage and movable into a blocking position upon movement of said needle valve element from said closed position toward said open position to prevent spill flow between said nozzle cavity and said spill passage.

9. The closed nozzle fuel injector of claim 8, wherein said spill passage includes a transverse passage extending transversely through said nozzle valve element and opening into said nozzle cavity when said nozzle valve element is in said closed position.

10. The closed nozzle fuel injector of claim 6, further including a biasing spring operatively connected to said nozzle valve element for biasing said nozzle valve element into said closed position, said injector body including spring cavity containing said biasing spring, said spring cavity forming a portion of said spill circuit.

11. The closed nozzle fuel injector of claim 10, wherein said spill valve means further functions to block fuel flow through said spill circuit when said nozzle valve element is positioned in said closed position.

12. The closed nozzle fuel injector of claim 11, wherein said nozzle valve element includes an inner end positioned adjacent said injector orifice and an outer end positioned a spaced distance from said inner end, said spill passage including an axial passage extending from said inner end along a central longitudinal axis of said nozzle valve element toward said outer end, said spill valve means including a valve surface formed on said inner end of said nozzle valve element and a corresponding valve seat formed on said injector body adjacent said injector orifice for engagement by said valve surface when said nozzle valve element is in said closed position to block fuel flow from said nozzle cavity to said spill passage and said injector orifice.

13. The closed nozzle injector of claim 12, wherein said spill circuit includes an annular recess formed in said injector body adjacent said nozzle valve element, said spill passage including a lateral passage providing fluidic communication between said axial passage and said annular recess, said rate shaping means further including a flow limiting orifice formed in said lateral passage for limiting the flow through said spill passage to a predetermined maximum spill flow rate.

14. The closed nozzle injector of claim 13, wherein said spill valve means includes an annular step integrally formed on said nozzle valve element and an annular valve seat formed on said injector body for sealing engagement by said annular step upon movement of said nozzle valve element into said open position to prevent spill flow through said spill circuit.

15. The closed nozzle injector of claim 1, wherein said rate shaping control means further includes a spill accelerating means positioned along said spill circuit for creating a rapid increase in the spill flow rate during each injection event.

16. The closed nozzle injector of claim 15, wherein said spill accelerating means includes a spill chamber formed in said nozzle valve element for receiving spill fuel from said spill passage, said spill passage including a transverse cross sectional area upstream of said spill chamber, said spill chamber including a transverse cross-sectional area greater than said transverse cross sectional area of said spill passage.

17. The closed nozzle fuel injector of claim 15, wherein said spill passage includes an axial passage and said spill accelerating means includes a transverse spill chamber formed in said nozzle valve element and extending generally transverse to said axial passage for receiving spill fuel from said spill passage.

18. The closed nozzle fuel injector of claim 15, wherein said rate shaping control means further includes a flow limiting orifice positioned in said spill circuit for limiting the spill flow through said spill passage to a predetermined maximum spill flow rate, said flow limiting orifice being formed at least partially by said nozzle valve element and positioned along said spill circuit downstream of said spill accelerating means.

19. A closed nozzle fuel injector adapted to inject fuel at high pressure into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice and a low pressure drain circuit for draining fuel from said injector cavity;

a nozzle valve element positioned in one end of said injector cavity adjacent said injector orifice, said nozzle valve element movable between an open position in which fuel may flow from said fuel transfer circuit through said injector orifice into the combustion chamber and a closed position in which fuel flow through said injector orifice is blocked, movement of said nozzle valve element from said closed position to said open position and from said open position to said closed position defining an injection event during which fuel may flow through said injector orifice into the combustion chamber;

a rate shaping control means for varying the flow rate of fuel injected into the combustion chamber during said injection event to create a low injection flow rate through said injector orifice followed by a high injection flow rate greater than said low injection flow rate, said rate shaping control means including an injection spill circuit for spilling a portion of the fuel to be injected from said fuel transfer circuit to said low pressure drain circuit during said injection event to create said low injection flow rate, wherein said nozzle valve element blocks fuel flow through said spill circuit when positioned in said closed position.

20. The closed nozzle fuel injector of claim 19, wherein said nozzle valve element includes an inner end positioned adjacent said injector orifice and an outer end positioned a spaced distance from said inner end, said nozzle valve element including a valve surface formed on said inner end of said nozzle valve element and a corresponding valve seat formed on said injector body adjacent said injector orifice for sealing engagement by said valve surface when said nozzle valve element is in said closed position to prevent fuel flow from said fuel transfer circuit to both said spill passage and said injector orifice.

21. The closed nozzle injector of claim 20, said spill passage including an axial passage extending from said inner end along a central longitudinal axis of said nozzle valve element toward said outer end, said spill circuit including an annular recess formed in said injector body adjacent said nozzle valve element, said spill passage including a lateral passage providing fluidic communication between said axial passage and said annular recess.

22. The closed nozzle injector of claim 21, said rate shaping means further including a flow limiting orifice formed in said lateral passage for limiting the flow through said spill passage to a predetermined maximum spill flow rate.

23. The closed nozzle fuel injector of claim 21, wherein said rate shaping control means further includes a spill valve means for controlling the spill flow of fuel through said spill circuit to create said high injection flow rate.

24. The closed nozzle injector of claim 23, wherein said spill valve means includes an annular step integrally formed on said nozzle valve element and an annular valve seat formed on said injector body for sealing engagement by said annular step upon movement of said nozzle valve element into said open position to prevent spill flow through said spill circuit.

25. The closed nozzle injector of claim 19, wherein said rate shaping control means further includes an spill accelerating means positioned along said spill circuit for creating a rapid increase in the spill flow rate during each injection event.

26. The closed nozzle injector of claim 25, wherein said spill circuit includes a spill passage formed in said nozzle valve element, said spill accelerating means including a spill chamber formed in said nozzle valve element for receiving spill fuel from said spill passage, said spill passage including an upstream transverse cross sectional area upstream of said spill chamber, said spill chamber including a transverse cross-sectional area greater than said upstream transverse cross sectional area of said spill passage.

27. A closed nozzle fuel injector adapted to inject fuel at high pressure into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice and a low pressure drain circuit for draining fuel from said injector cavity;

a nozzle valve element positioned in one end of said injector cavity adjacent said injector orifice, said nozzle valve element movable between an open position in which fuel may flow from said fuel transfer circuit through said injector orifice into the combustion chamber and a closed position in which fuel flow through said injector orifice is blocked, movement of said nozzle valve element from said closed position to said open position and from said open position to said closed position defining an injection event during which fuel may flow through said injector orifice into the combustion chamber;

a rate shaping control means for producing a predetermined time varying change in the flow rate of fuel injected into the combustion chamber during said injection event so as to create a low injection flow rate through said injector orifice followed by a high injection flow rate greater than said low injection flow rate during said injection event, said rate shaping control means including an injection spill circuit for spilling a portion of the fuel to be injected from said fuel transfer circuit to said low pressure drain circuit during said injection event and a spill valve means for controlling the spill flow of fuel through said spill circuit, said spill valve means being movable into a spill position to permit spill fuel flow through said spill circuit to create said low injection rate and a blocking position substantially preventing flow through said spill circuit, said spill valve means at least partially formed by said nozzle valve element.

28. The closed nozzle fuel injector of claim 27, wherein said spill valve means includes an annular valve seat formed on said injector body and a movable valve member for intermittently engaging said annular valve seat to block the spill flow through said spill circuit, said movable valve member including a convex seal surface.

* * * * *